US009200544B2

(12) United States Patent
Kunz et al.

(10) Patent No.: US 9,200,544 B2
(45) Date of Patent: Dec. 1, 2015

(54) CAMSHAFT AND FUNCTIONAL ELEMENTS FOR A CAMSHAFT

(71) Applicant: THYSSENKRUPP PRESTA TECCENTER, Eschen (LI)

(72) Inventors: Michael Kunz, Muelsen (DE); Bernd Mann, Zschopau (DE); Markus Melzer, Burkhardtsdorf (DE); Juergen Meusel, Dittmannsdorf (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 82 days.

(21) Appl. No.: 14/350,412

(22) PCT Filed: Oct. 8, 2012

(86) PCT No.: PCT/EP2012/069866

§ 371 (c)(1),
(2) Date: Apr. 8, 2014

(87) PCT Pub. No.: WO2013/053669

PCT Pub. Date: Apr. 18, 2013

(65) Prior Publication Data

US 2014/0245980 A1 Sep. 4, 2014

(30) Foreign Application Priority Data

Oct. 10, 2011 (DE) ..... 10 2011 054 350

(51) Int. Cl.
*F01L 1/34* (2006.01)
*F01L 1/344* (2006.01)
(Continued)

(52) U.S. Cl.
CPC ..... *F01L 1/344* (2013.01); *F01L 1/047* (2013.01); *F01L 1/08* (2013.01); *F01L 1/3442* (2013.01);
(Continued)

(58) Field of Classification Search
CPC ..... F01L 1/08; F01L 1/047; F01L 1/344; F01L 1/3442; F01L 2001/0473; F01L 2103/01
USPC ..... 123/90.15, 90.16, 90.17, 90.6
See application file for complete search history.

(56) References Cited

U.S. PATENT DOCUMENTS 7,513,232 B2 * 4/2009 Schneider ..... F01L 1/34 123/90.15

(Continued)

FOREIGN PATENT DOCUMENTS

DE 10 2010 036 145 7/2011
JP 2004-44445 2/2004

*Primary Examiner* — Ching Chang
(74) *Attorney, Agent, or Firm* — Michael J. Striker

(57) ABSTRACT

The invention relates to a camshaft, in particular for motor vehicle engines, comprising an outer shaft (1), an inner shaft (2) arranged coaxially in the outer shaft (1), first functional elements (3) rigidly arranged on the outer shaft (1), second functional elements (4*a*, 4*b*), which are rotatably arranged on the outer shaft (1) and fastened to the inner shaft (2) in a rotationally fixed manner, and a phase adjuster (5) connected to the outer shaft (1) and the inner shaft (2) for rotating the inner shaft (2) relative to the outer shaft (1), wherein the phase adjuster (5) is fastened to the inner shaft (2) and thereby a torque is applied. According to the invention, one of the functional elements (4*a*, 4*b*) connected to the inner shaft (2) in a rotationally fixed manner has tool accommodation surfaces (11) on the cylindrical surface side outside of a functional surface (12*a*, 12*b*). The invention further relates to such a functional element.

7 Claims, 6 Drawing Sheets

Figure 1:
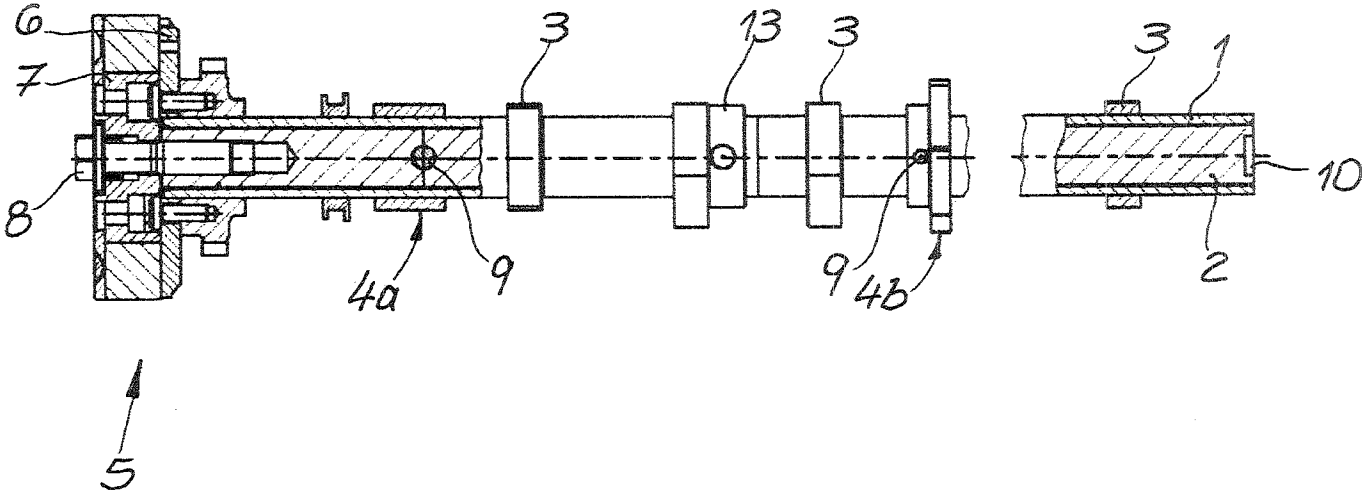
Fig.1 Prior Art

(51) Int. Cl.

| | |
|---|---|
| ***F01L 1/047*** | (2006.01) |
| ***F01L 1/08*** | (2006.01) |
| ***F01L 1/46*** | (2006.01) |

(52) U.S. Cl.

CPC ..... *F01L 1/46* (2013.01); *F01L 2001/0473* (2013.01); *F01L 2103/01* (2013.01); *F01L 2103/02* (2013.01); *F01L 2800/17* (2013.01)

(56) References Cited

U.S. PATENT DOCUMENTS

| | | | |
|---|---|---|---|
| 8,096,275 | B2 | 1/2012 | Marriott et al. |
| 2007/0215075 | A1 | 9/2007 | Hutter et al. |
| 2012/0000436 | A1 | 1/2012 | Schneider et al. |
| 2012/0160055 | A1 | 6/2012 | Tateno |

* cited by examiner

Fig.5
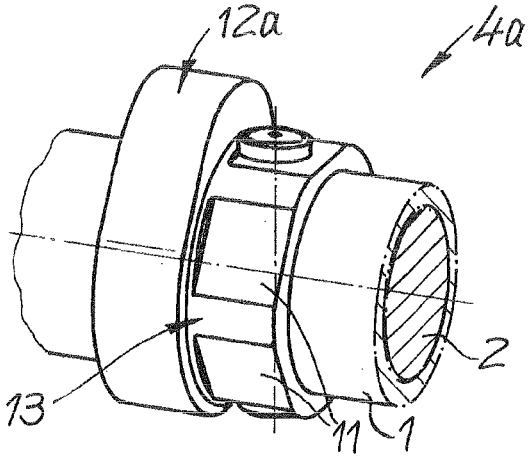
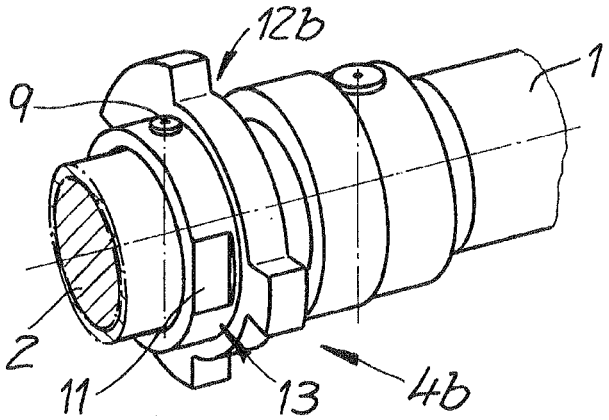
Fig.6

CAMSHAFT AND FUNCTIONAL ELEMENTS FOR A CAMSHAFT

CROSS-REFERENCE TO A RELATED APPLICATION

The invention described and claimed hereinbelow is also described in German patent Application 10 2011 054 350.3 filed on Oct. 10, 2011. This German Patent Application, whose subject matter is incorporated here by reference, provides the basis for a claim of priority of invention under 35 U.S.C. 119 (a)-(d).

The invention relates to a camshaft, in particular for motor vehicle engines, with an outer shaft and an inner shaft arranged coaxially in the outer shaft, with first functional elements rigidly arranged on the outer shaft, with second functional elements which are rotatably arranged on the outer shaft and fastened to the inner shaft in a rotationally fixed manner, and with a phase adjuster connected to the outer shaft and the inner shaft for rotating the inner shaft relative to the outer shaft, wherein the phase adjuster is fastened to the inner shaft thereby applying a torque.

A generic camshaft is known from DE 10 2010 036 145 A1. Provided opposite the phase adjuster, on an end face of the inner shaft, is a recess which enables centring and secure holding during assembly.

At least one part of the first functional elements as well as of the second functional elements are cams, which can control the intake and/or exhaust of an internal combustion engine. A variable control of the valves of the internal combustion engine is made possible by an adjustment of the cams fastened to the inner shaft relative to the cams fastened to the outer shaft. The ratio of the intake time and exhaust time can thus be varied, for example in a load- and speed-dependent manner. The rotation of the inner shaft and outer shaft takes place by means of a phase adjuster, which is also referred to as a phaser.

The phase adjuster usually comprises a stator connected to the outer shaft and a rotor connected to the inner shaft. It is however also possible for the engine to be connected to the outer shaft in a rotationally fixed manner via the inner shaft and the rotor. Apart from friction-locked, form-fit and/or firmly bonded connections, detachable connections by means of screwing are also known. The screwing usually takes place by means of a central screw, which in the fixed state lies adjacent to an end face of the phase adjuster and engages in an accommodation of the inner shaft. In order to be able to fasten the rotor to the inner shaft by means of the central screw with a preset tightening torque, a holding torque directed opposite to the tightening torque has to be applied. Since the inner shaft is arranged inside the outer shaft, the latter is held securely against the opposite end of the shaft when the central screw is tightened up. An assembly tool is usually provided for this purpose in practice, which engages in an assigned accommodation of the inner shaft. The drawback arises here that the tightening torque is transmitted over the entire length of the inner shaft, which is correspondingly twisted to a considerable extent. Depending on the length of the inner shaft, this torsion may be so great that the cams or other functional elements lying remote from the phase adjuster and being fastened to the inner shaft strike against an end position. It has to be taken into account that the functional elements assigned to the inner shaft are fastened by connecting elements which extend through slots on the outer shaft. The length of the slots is stipulated by the provided travel path between the inner shaft and the outer shaft.

In principle, there is the problem that the risk of an increased degree of inaccuracy exists due to the torsion of the entire inner shaft. Friction or jamming may mean that the total applied torque does not actually act on the screw connection. Especially with regard to the increased demands on the documentation of the production process, the described uncertainties are a drawback. In addition, the torsion of the entire inner shaft also leads to a lengthening of the angular range covered in the course of tightening up.

JP 2004 044 445 A relates to a generic, non-adjustable camshaft, wherein all the cams are arranged rigidly on a solid rod. Accordingly, the camshaft does not comprise any parts mobile relative to one another or a phase adjuster. In order to be able to hold the entire shaft securely during assembly, a hexagonal structure independent of the individual cams is arranged on a separate end piece.

Against this background, the problem underlying the invention is to reduce the twisted length of the inner shaft and thus to increase the accuracy and reproducibility during the fastening of the phase adjuster to the inner shaft by the application of a torque.

Proceeding from a camshaft with the initially described features, the problem is solved according to the invention by the fact that one of the second functional elements connected to the inner shaft in a rotationally fixed manner comprises tool accommodation surfaces on the cylindrical surface side outside of a functional surface. The second functional element provided with the tool accommodation surfaces can be one of the cams connected to the inner shaft, a sensor wheel, a bearing element or a bearing ring. In principle, it is also possible to provide an additional part which is intended solely to enable the counter-holding during the fastening of the phase adjuster.

A second functional element is expediently used, which lies close to the phase adjuster in order to achieve a toroidal length as small as possible. In principle, however, it is also possible to provide a plurality of functional elements with tool accommodation surfaces. If the tool accommodation surfaces are formed for example on a cam, no different cams need to be mounted if they are all provided with tool accommodation surfaces.

In the case of adjustable camshafts with an inner shaft and an outer shaft, it is known that the functional elements connected to the inner shaft on the one hand comprise a functional surface and on the other hand an annular collar axially offset with respect thereto, wherein the fastening of the functional elements to the inner shaft also takes place by means of a connecting element, for example a pin, at the annular collar. The tool accommodation surfaces can then be produced on the annular collar in a particularly straightforward manner.

According to a preferred embodiment of the invention, the tool accommodation surfaces are constituted as key surfaces for receiving a tool key. For example, two surfaces lying opposite on the periphery, a polygon or a differently constituted profile shape with teeth, or a polygonal shape or suchlike can be provided. During the fastening of the phase adjuster to the inner shaft, a suitable assembly tool is engaged with the tool accommodation surfaces and fixed there. The torques occurring during the tightening up are thus taken up by the assembly tool.

In particular, it is possible for the occurring torques to be taken up when the functional element provided with the tool accommodation surfaces is being securely held. By a comparison with the tightening torques applied to the phase adjuster, it can thus be ensured that the fastening is not impaired by jamming or suchlike.

The phase adjuster comprises a component connected to the outer shaft and a component connected to the inner shaft, wherein the connection with the inner shaft expediently takes place by means of a central screw. The component connected to the inner shaft is preferably the rotor of the phase adjuster.

The subject-matter of the invention is also a functional element for a camshaft, in particular a cam, with a hub, a functional surface on the cylindrical surface side and an annular collar offset with respect to the functional surface along the axis of the hub, wherein the previously described tool accommodation surfaces are disposed on the annular collar.

Figure 2:
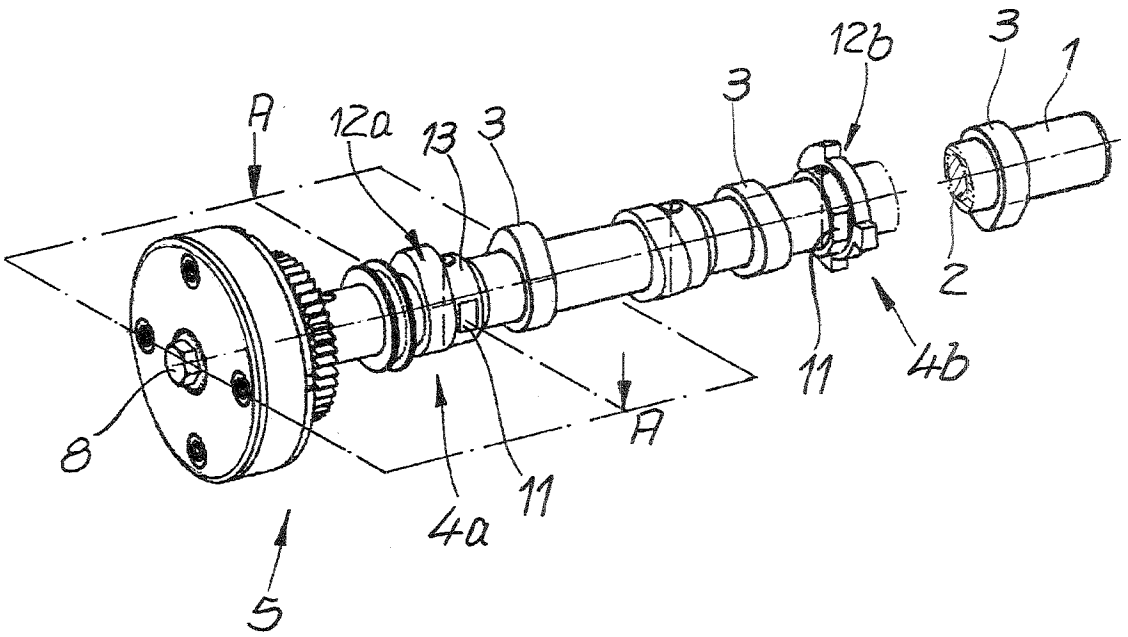
Figure 3:
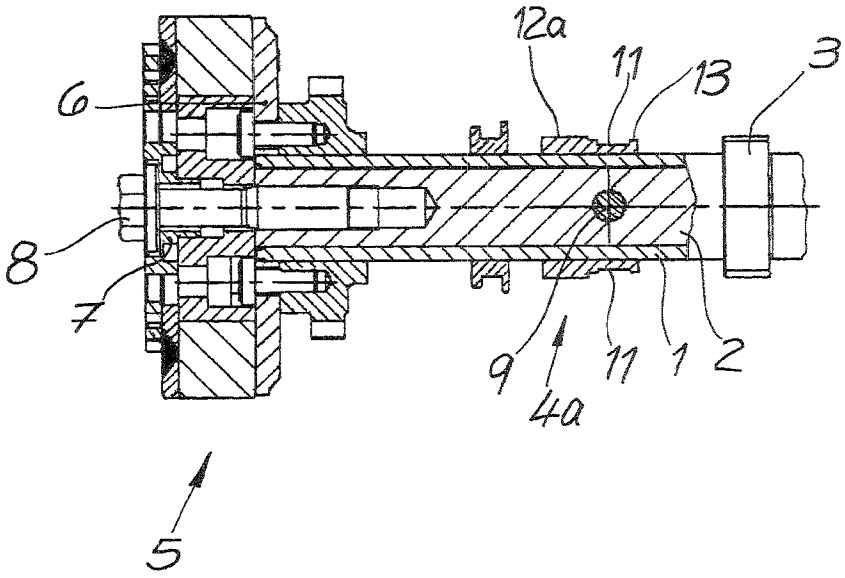
Figure 4A:
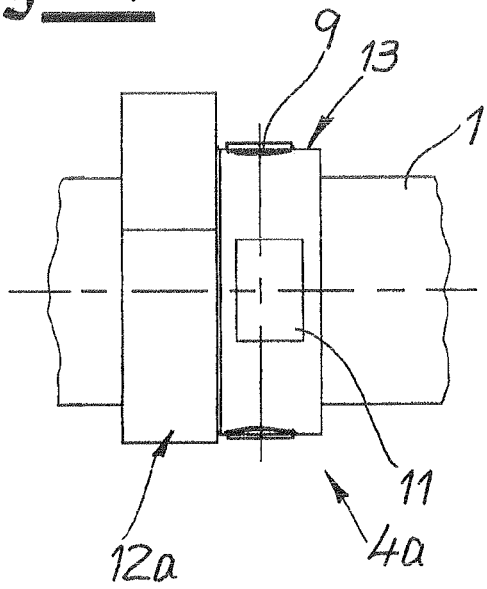
Figure 4B:
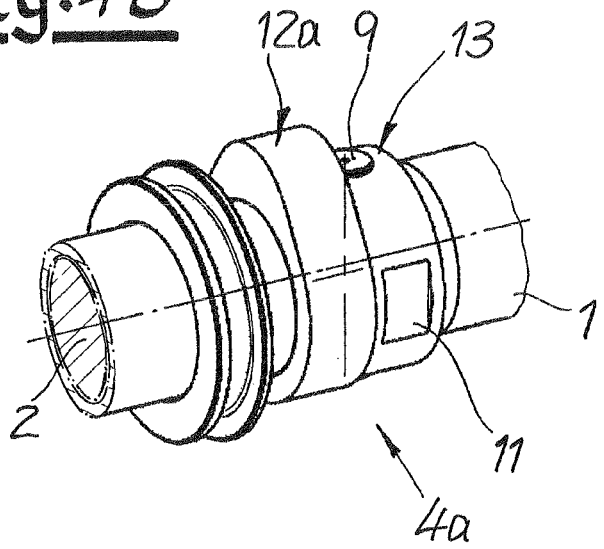
Figure 7A:
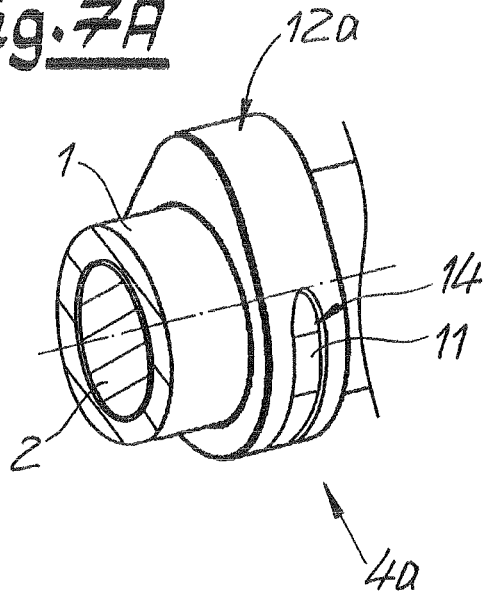
Figure 7B:
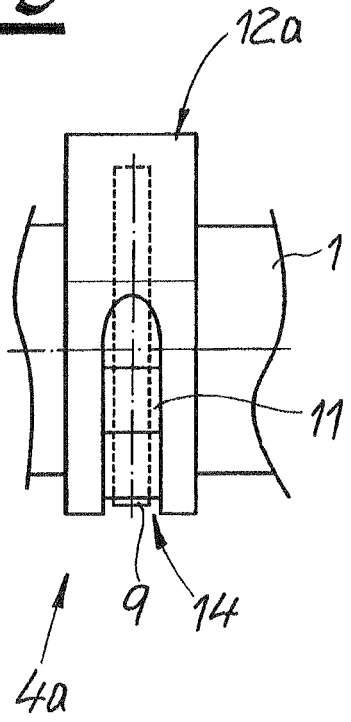

The invention is explained below with the aid of a drawing merely representing an example of embodiment. In the figures, in a diagrammatic representation:

FIG. 1 shows an adjustable camshaft, with a detachably fastened phase adjuster according to the prior art in a longitudinal cross-section, FIG. 2 shows a camshaft according to the invention in a perspective view, FIG. 3 shows a partial region of the camshaft represented in FIG. 2 in a longitudinal cross-section along line A-A of FIG. 2, FIGS. 4*a* and 4*b* shows a cam connected to an inner shaft in a detail view from the side and in perspective, FIG. 5 shows an alternative embodiment of a cam connected to the inner shaft, FIG. 6 shows a sensor wheel connected to the inner shaft, FIGS. 7*a* and 7*b* shows a detail of an adjustable camshaft with an alternative embodiment of a cam connected to the inner shaft in a perspective view and a side view.

FIG. 1 shows the structure, known from the prior art, of an adjustable camshaft of an internal combustion engine with an outer shaft 1 and an inner shaft 2 arranged coaxially in outer shaft 1. First functional elements 3 in the form of cams are fastened to outer shaft 1. Second functional elements 4*a*, 4*b* in the form of cams or in the form of a sensor wheel are fastened in a rotationally fixed manner to inner shaft 2. In order to rotate first functional elements 3 relative to second functional elements 4*a*, 4*b*, a phase adjuster 5 is arranged on the end face.

Phase adjuster 5, which is also referred to as a phaser, comprises a stator 6 connected to outer shaft 1 and a rotor 7 connected to inner shaft 2. A rotation between stator 6 and rotor 7 can take place for example hydraulically, so that a controlled adjustment of inner shaft 2 relative to outer shaft 1 is possible by means of a suitable control.

Rotor 7 is fastened to inner shaft 1 with a central screw 8 by applying a tightening torque. The fastening of second functional elements 4*a*, 4*b* to the inner shaft takes place in the example of embodiment by means of connecting elements 9 such as for example pins, which are pressed in during the assembly and are guided through the longitudinal slots of outer shaft 1, said slots not being represented in the figures. In order to be able to fasten rotor 7 to inner shaft 2 by means of central screw 8, inner shaft 2 must be held secure during the tightening-up of central screw 8. According to the embodiments known from the prior art, a tool accommodation 10 is provided for this purpose at the opposite end of inner shaft 2.

The drawback arises here that entire inner shaft 2 is twisted during the tightening-up. Even if inner shaft 2 can in itself withstand the stresses, the small diameter leads to a raised sensitivity to torsion.

Proceeding from the known embodiment according to FIG. 1, provision is made according to the invention such that the length of inner shaft 2 required for the transmission is reduced by the fact that counter-holding against one of the two functional elements 4*a*, 4*b* is possible during the tightening-up. FIG. 2 thus shows an embodiment according to the invention, wherein first functional element 4*a*, in the form of a cam, of second functional elements 4*a*, 4*b* connected to inner shaft 2 is provided with tool accommodation surfaces 11 on the cylindrical surface side. These tool accommodation surfaces 11 are located on an annular collar 13 outside actual functional surface 12*a*, which has the cam shape provided for the control of the valves.

It is particularly advantageous if, proceeding from phase adjuster 5, the first of second functional elements 4*a*, 4*b* is provided with tool accommodation surfaces 11.

It can also be seen from FIG. 2 that not only a cam, but also another second functional element 4*b* in the form of a sensor wheel can be provided with tool accommodation surfaces 11, wherein the arrangement of tool accommodation surfaces 11 takes place, here too, outside functional area 12*b* of the sensor wheel on an annular collar 13.

Solely for the purpose of illustration, two of second functional elements 4*a*, 4*b* are provided with tool accommodation surfaces 11 in FIG. 2. In principle, it is sufficient if only one of second functional elements 4*a*, 4*b* comprises corresponding tool accommodation surfaces 11.

The details of second functional element 4*a* in the form of a cam, represented in FIG. 2, are represented in FIGS. 3, 4*a* and 4*b*. It can be seen in FIG. 3 that annular collar 13 is to a certain extent weakened by the introduction of tool accommodation surfaces 11. Against this background, it is expedient if, according to the example of embodiment, tool accommodation surfaces 11 are disposed offset by 90° with respect to the pin on the periphery of annular collar 13.

FIG. 5 shows an alternative embodiment, wherein the shape of a polygon is provided instead of two tool accommodation surfaces 11 exactly opposite one another. The advantage arises that a tool can be placed in different orientations for the counter-holding.

Finally, FIG. 6 shows an embodiment, wherein two opposite tool accommodation surfaces 11 are provided on second functional element 4*b* in the form of a sensor wheel.

As a result of the described embodiment of the camshaft, the accuracy and reliability can be increased during the fastening of phase adjuster 5 to inner shaft 2 by means of central screw 8. Moreover, tool accommodation surfaces 11 can however also be used in a different way, in order to hold secure the assigned second functional elements 4*a*, 4*b*, for example if second functional elements 4*a* in the form of cams are ground to size before or after assembly.

FIGS. 7*a* and 7*b* show the detail of a camshaft with an alternative embodiment of second functional elements 4*a* in the form of cams connected to inner shaft 2. In contrast with the embodiments described above, the cam does not comprise an annular collar 13. Instead, functional surface 12*a* is interrupted by a cutout 14 on a part of the cylindrical surface of the cam, wherein on the one hand connecting element 9 in the form of a pin is arranged in the cutout and tool accommodation surfaces 11 are provided. The described alternative embodiment of second functional elements 4*a* leads to a smaller material and space requirement.

The invention claimed is:

1. A camshaft, for motor vehicle engines, with an outer shaft (1) and an inner shaft (2) arranged coaxially in the outer shaft (1), with first functional elements (3) rigidly arranged on the outer shaft (1), with second functional elements (4*a*, 4*b*), which are rotatably arranged on the outer shaft (1) and fastened to the inner shaft (2) in a rotationally fixed manner, and with a phase adjuster (5) connected to the outer shaft (1) and the inner shaft (2) for rotating the inner shaft (2)

relative to the outer shaft (1), wherein the phase adjuster (5) is fastened to the inner shaft (2) thereby applying a torque, characterised in that one of the second functional elements (4*a*, 4*b*) connected to the inner shaft (2) in a rotationally fixed manner comprises tool accommodation surfaces (11) on a cylindrical surface side outside of a functional surface (12*a*, 12*b*).

2. The camshaft according to claim 1, characterised in that the phase adjuster (5) comprises a stator (6) connected to the outer shaft (1) and a rotor (7) connected to the inner shaft (2) by means of screwing.

3. The camshaft according to claim 1, characterised in that the phase adjuster (5) and the inner shaft (2) are connected by means of a central screw (8).

4. The camshaft according to claim 1, characterised in that the tool accommodation surfaces (11) are constituted as key surfaces for receiving a tool key.

5. The camshaft according to claim 1, characterised in that the functional element (4*a*, 4*b*) provided with the tool accommodation surfaces (11) comprises an annular collar (13) arranged offset with respect to the functional surfaces (12*a*, 12*b*) in the axial direction of the camshaft, at which annular collar the functional element (4*a*, 4*b*) is fastened by means of a connecting element (9) to the inner shaft (2) and at which annular collar tool accommodation surfaces (11) are formed.

6. The camshaft according to claim 1, characterised in that, proceeding from phase adjuster (5), the first of the second functional elements (4*a*) is provided with tool accommodation surfaces (11).

7. A functional element (4*a*, 4*b*) for a camshaft according to claim 1, a cam, with a hub, a functional surface (12*a*, 12*b*) on the cylindrical surface side and an annular collar (13) offset with respect to the functional surface (12*a*, 12*b*) along the axis of the hub, wherein tool accommodation surfaces (11) are formed on the annular collar (13).

* * * * *